US008182218B2

(12) United States Patent
Pearce et al.

(10) Patent No.: US 8,182,218 B2
(45) Date of Patent: May 22, 2012

(54) VENT AND GRILLES

(76) Inventors: Allan Pearce, Wodonga (AU); Bill Hendriks, Lilydale (AU)

( * ) Notice: Subject to any disclaimer, the term of this patent is extended or adjusted under 35 U.S.C. 154(b) by 860 days.

(21) Appl. No.: 11/913,899

(22) PCT Filed: May 12, 2006

(86) PCT No.: PCT/AU2006/000612

§ 371 (c)(1),
(2), (4) Date: Nov. 8, 2007

(87) PCT Pub. No.: WO2006/119564

PCT Pub. Date: Nov. 16, 2006

(65) Prior Publication Data

US 2008/0166232 A1 Jul. 10, 2008

(30) Foreign Application Priority Data

May 12, 2005 (AU) ..... 2005902417

(51) Int. Cl.
*F03D 1/04* (2006.01)

(52) U.S. Cl. ..... 415/220; 416/247 R

(58) Field of Classification Search ..... 415/191, 415/213.1, 220; 416/247 R, DIG. 8; 454/347, 454/355, 358
See application file for complete search history.

(56) References Cited

U.S. PATENT DOCUMENTS

| | | | | |
|---|---|---|---|---|
| 4,336,749 | A * | 6/1982 | Barnhart et al. | 454/349 |
| 5,758,716 | A * | 6/1998 | Shibata | 165/41 |
| 6,764,277 | B2 * | 7/2004 | Somahara et al. | 415/121.2 |
| 2004/0033135 | A1 | 2/2004 | Chang | |

FOREIGN PATENT DOCUMENTS

| | | | |
|---|---|---|---|
| FR | 2334061 | A1 | 7/1977 |
| JP | 58070099 | A * | 4/1983 |

* cited by examiner

*Primary Examiner* — Edward Look
*Assistant Examiner* — Dwayne J White
(74) *Attorney, Agent, or Firm* — Edwin D. Schindler

(57) ABSTRACT

A fan assembly includes a casing, which is substantially cylindrical in shape with a fan motor and fan blades located therein, so that air can be drawn into the casing and delivered therefrom. A grille extends over an open end of the casing and has a plurality of angular curved blades extending from a central portion thereof to the periphery. These curved blades are, preferably, at an angle to the normal plane through the grille, so that air in the casing is caused to move to the fan blades at an angle permitting efficient operation of the fan.

12 Claims, 5 Drawing Sheets

VENT AND GRILLES

TECHNICAL AREA

This invention relates to a vent and grille and, in particular, to a vent and grille which can be used in association with a fan to draw air from an area.

BACKGROUND TO THE INVENTION

It is well-known to provide fans which can remove air from an area, and particularly, for use in kitchens, bathrooms or the like, where they are called exhaust fans.

Most such fans used in Australia are located in an aperture in the ceiling, have a grille extending into the room and a fan mounted thereabove.

In some applications, and in many applications overseas, the fan may be located in a casing and connected to an exhaust duct whereby the air removed is delivered to the exterior of the building in which the fan is located.

OUTLINE OF THE INVENTION

It is the object of the present invention to provide a fan and grille and a grille arrangements for fans for use in such applications.

The invention, in one sense, provides a fan assembly including a casing which is generally cylindrical in form and which has located therein a fan motor and fan blades whereby air can be drawn into the casing, and delivered therefrom, and having a grille extending over an open end of the casing.

It is preferred that the grille has a plurality of angular curved blades extending from a central portion thereof to the periphery.

These blades are preferably at an angle to the normal plane through the grille whereby inlet air into the casing is caused to move to the fan blades at and angle which permits efficient operation of the fan.

In some applications the down-stream end of the casing is provided with a connector whereby duct-work can be connected thereto.

It is preferred that there is a flap-valve or the like whereby any passage of air through the casing, particularly from the down stream side, is normally restricted, but which, on operation of the fan, opens to permit relatively unrestricted flow of air through the casing.

The invention also provides a grille for a fan assembly including a casing which is generally cylindrical in form and which has located therein a fan motor and fan blades whereby air can be drawn within the casing and having a plurality of angular curved blades extending from a central portion thereof to the periphery.

The angular curved blades of the grille are at an angle to the normal through the grille.

DESCRIPTION OF AN EMBODIMENT OF THE INVENTION

In order that the invention may be more readily understood, we shall describe one particular embodiment in relation to the accompanying drawings, in which.

Figure 1:
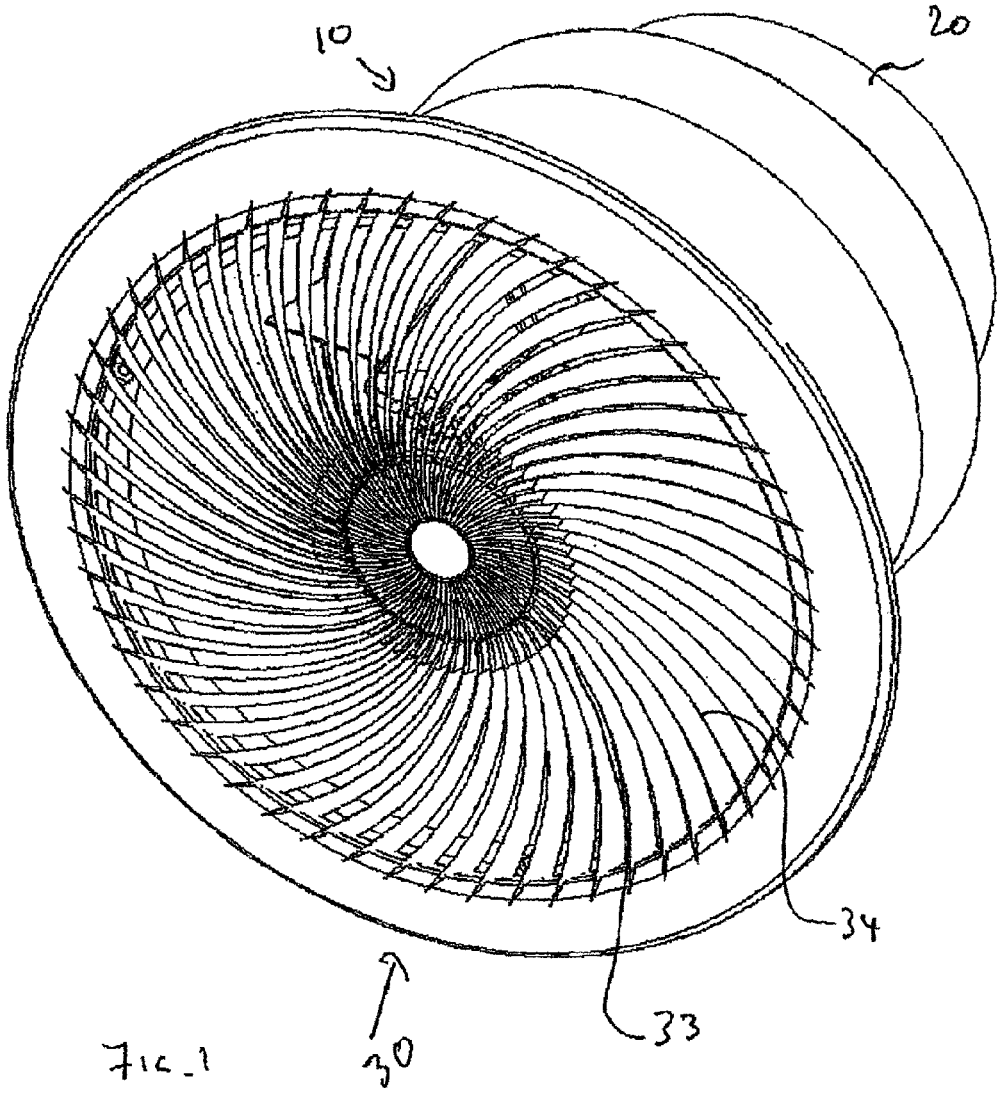
FIG. 1 shows a perspective view from beneath the assembly.

In this embodiment we have a casing 10 which, over a major part of its length 11, is fustoconical in form and which has at its lower (by definition the portion which would extend into a room or the like) end an outwardly directed flange 12 which can serve as a stop against an aperture in the ceiling or wall, into which the device is to be located.

At its inner end 20 (the opposite end) the casing may have a cylindrical portion 36 to which a duct may be connected or which may be free.

Figure 2:
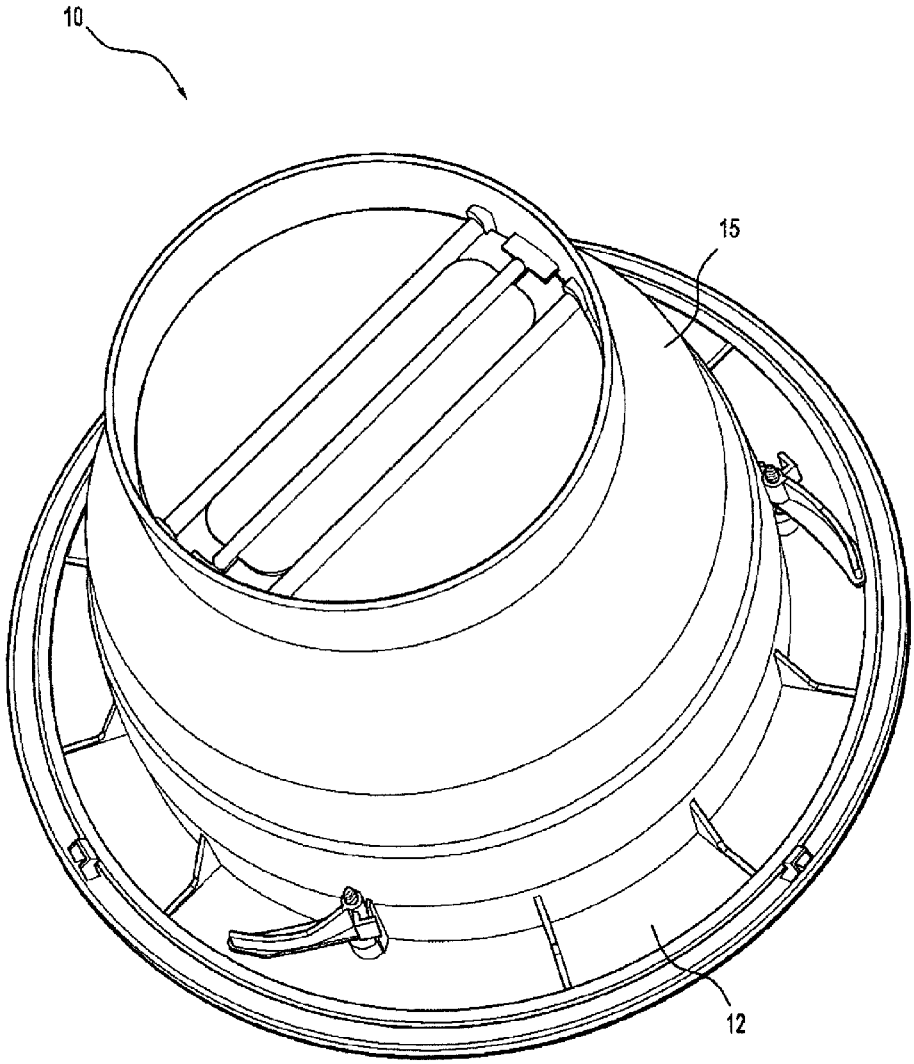
FIG. 2 shows a perspective view from above the assembly.

Mounted in the body of the casing there is a fan motor and fan blades, not shown but the mount for this is shown as 15 in FIG. 2 which, on operation, can draw air through the casing.

Figure 3:
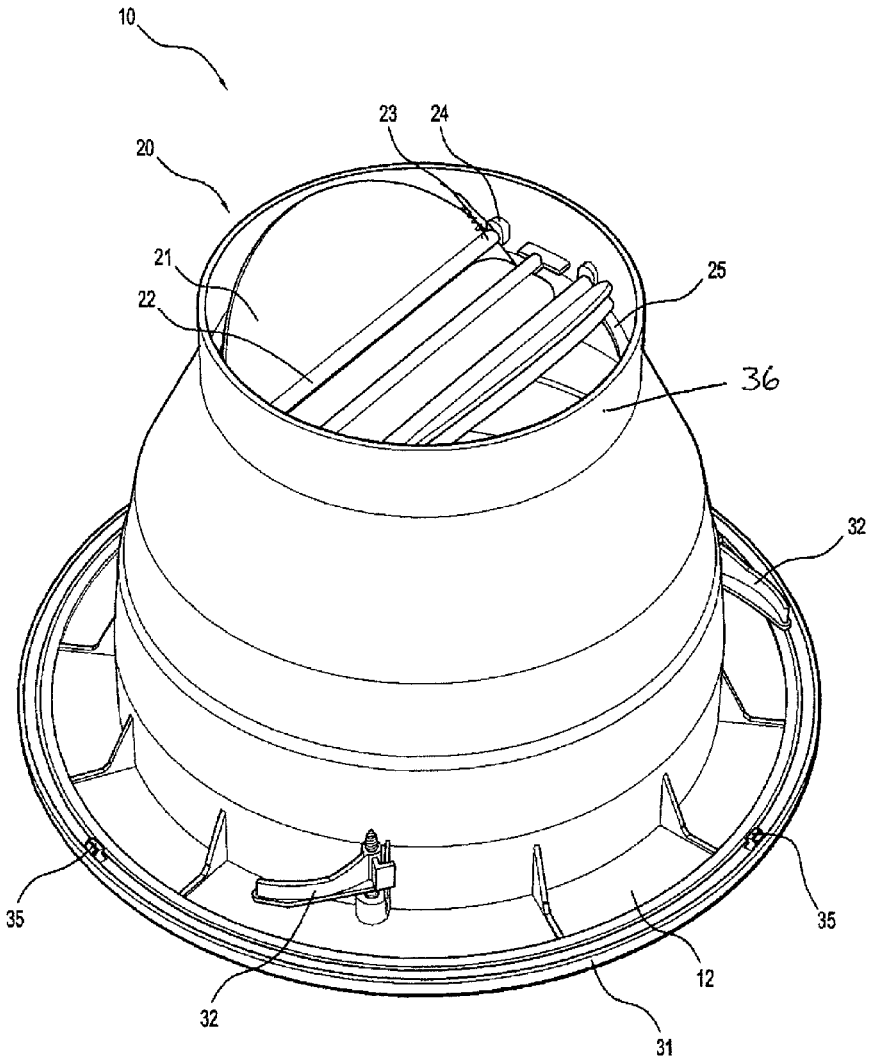
FIG. 3 shows a side elevation of the assembly.
Figure 4:
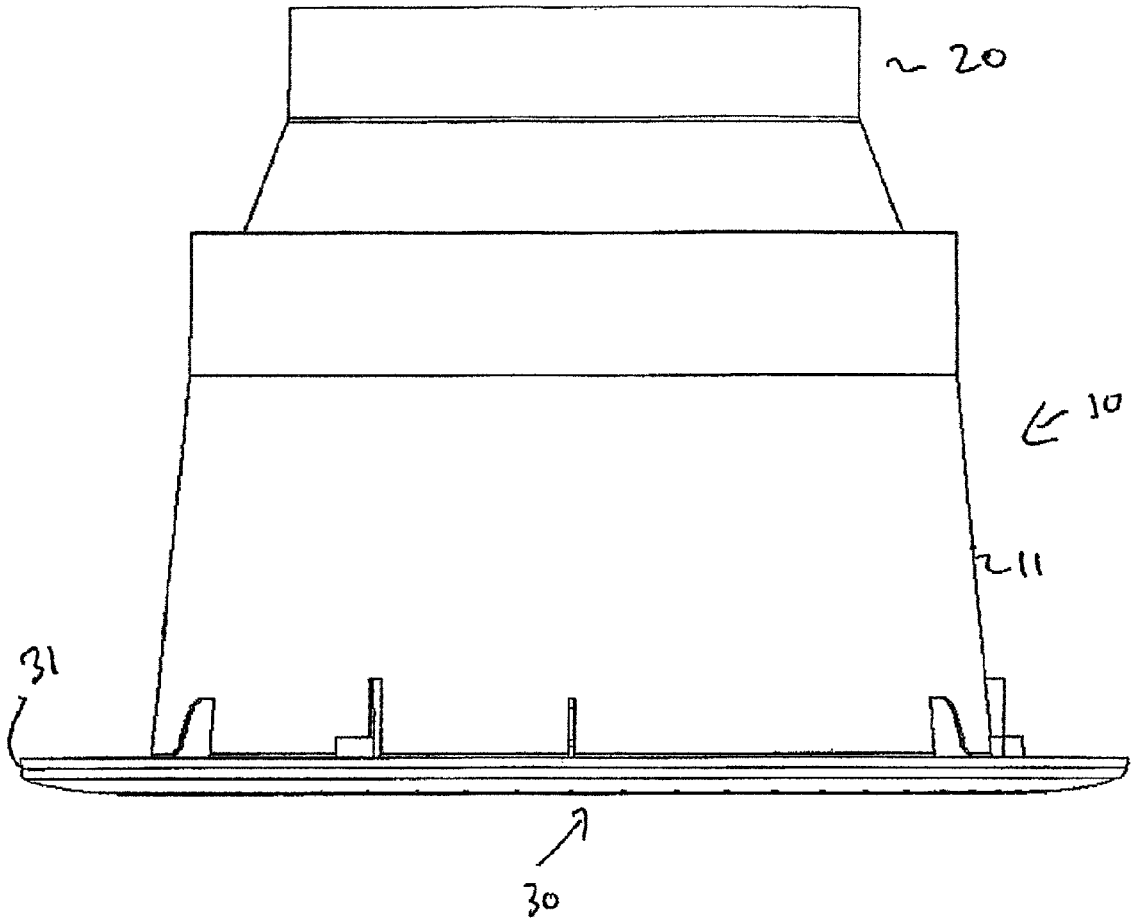
FIG. 4 shows a perspective view into the casing, with the fan removed.
Figure 5:
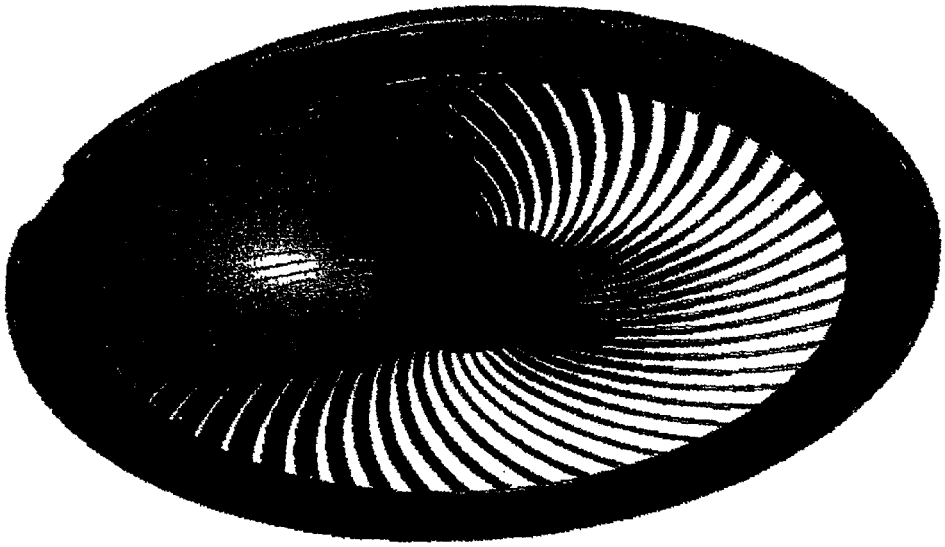
FIG. 5 shows an underneath view of the grille.

Located in the inner end 20, there is a flap valve 21 or the like which is biased to be normally closed, the position illustrated in FIG. 3. The flap valve has a shaft 22, which may be moulded integral therewith and rotatably mounted directly or indirectly to a bearing in a member 23 which is connected to supports 24 moulded into the casing. The biasing of the flap valve either being by the shaft thereof being slightly off-centre or by the addition of a bias weight. The flap valve rests against a stop means 25 connected to a side wall of the casing on one side of the casing to restrict movement in that direction.

At the open end of the casing, and connected to the flange 12 we provide a grille 30 which has an outer annular portion 31 which can be of a diameter greater than the diameter of the flange 12 of the casing. Clips 32 are provided to connect the grills 30 to the flange 12.

The grille has, extending from the centre thereof 33 to the annular portion 31, a plurality of ribs 34.

These ribs are each identical in form and are curved somewhat into the appearance of a turbine blade, that is, over most of their length they are displaced from a radius from the centre 33 to the point of their connection on the annular portion. That is, they are formed away from the radius, and then back to the radius.

In section, as can be seen from FIG. 1, they lie effectively at an angle to the normal plane of the annular portion which includes the centre of the grille and the point of connection of the rib to the annular portion by an amount which varies from a minimum at the centre, where they can effectively be normal to the plane, to a maximum at the point of connection to the annular portion.

As mentioned, the grille can be removably connected to the flange 12 of the casing so that it can be removed for cleaning and so that access can be obtained to the fan and fan motor and it also may be provided with clips which can retain the assembly in an aperture in the ceiling, wall, or the like.

The annular portion 12 may have upwardly extending lugs, having an outwardly-directed portion adjacent their end away from the surface of the annular member which can act as clips to connect the grille to the casing.

In use, the assembly may be passed through an aperture in a ceiling or wall and, depending upon the ceiling space, the fan may be wired before location or afterwards, and the clips 35 around the periphery retain the assembly in position.

It may be preferred that this location be effected before the grille 30 is connected and, once located, the grille can be connected to the flange 12 of the casing.

In use, when the fan is operated, the flap valve 21, as described earlier, will open to provide little resistance to the through movement of the air.

The particular formation of the grille 30 has two main benefits over previous grilles.

Firstly, because of the angular location of the ribs 34, from many positions, the fact that the grille is open cannot be seen and, from other positions, the degree of the exposure of the grille is only relatively minor.

This is desirable aesthetically as more conventional grilles tend to be unsightly and, particularly when they have been in use for any period, particularly in kitchens, tend to get a buildup of fat and soot and this can be unsightly.

The other aspect of the grille is that the formation of the ribs 34 is such that air, when drawn into the casing, is caused to effectively rotate about the central axis of the casing and this moving column of air is drawn through the fan and strikes the fan blades at an optimal angle to permit effective delivery of the air through the casing 10 to the exterior or to the ducting. At the same time, because the air is already moving prior to striking the fan blades, there tends to be a reduction in noise when the air passes therethrough.

It will be seen that the fan and casing and grille of the invention provides an assembly which is aesthetically pleasing, the grille can be readily removed for cleaning and the transmission of air through the grille into the casing and therefrom is efficient and quiet.

The particular formation of the blades in the grille may be varied, as may be the construction of the casing and the flat valve, if provided, without departing from the spirit and scope of the invention.

We claim:

1. A fan assembly, comprising:

a substantially cylindrical casing having an open end;

fan blades mounted in said substantially cylindrical casing;

a fan motor located within said substantially cylindrical casing for rotating said fan blades; and, a grille extending over the open end of said substantially cylindrical casing, said grille including:

an annular peripheral portion lying in a grille plane; and, a plurality of curved blades extending from a central portion of said grille to said annular peripheral portion, said curved blades being at a minimum angle to a normal plane normal to the grille plane at said central portion of said grille and a maximum angle to the normal plane at said annular peripheral portion, wherein, air is able to be drawn into said substantially cylindrical casing through said grille for rotating the air about a central axis of said substantially cylindrical casing for striking, and thereby moving, said fan blades at an angle for permitting efficient operation of said fan assembly.

2. The fan assembly according to claim 1, further comprising a valve at an inner end of said substantially cylindrical casing opposite to the open end of said substantially cylindrical casing, said valve restricting air flow from a downstream side, while permitting substantially unrestricted air flow through said grille and through said substantially cylindrical casing.

3. The fan assembly according to claim 2, wherein said valve has an open position and a closed position and is biased to the closed position.

4. The fan assembly according to claim 3, wherein said valve is a flap valve biased to the closed position via a bias weight.

5. The fan assembly according to claim 2, wherein said valve is rotatable and has an open position and a closed position, and in the closed position, said valve rests on stop means connected to a side wall of said substantially cylindrical casing.

6. The fan assembly according to claim 1, further comprising a connector located at a downstream end of said substantially cylindrical casing and being connectable to ductwork.

7. The fan assembly according to claim 1, wherein each fan blade of said fan blades has a substantially identical shape.

8. The fan assembly according to claim 1, wherein each fan blade of said fan blades over most of a length of said fan blade is displaced from a radius from a center point to a point of a connection of said fan blade on said annular peripheral portion where said fan blade returns to the radius.

9. The fan assembly according to claim 1, wherein said substantially cylindrical casing is frustoconical in shape over a majority portion of its length.

10. The fan assembly according to claim 1, wherein the open end of said substantially cylindrical casing has an outwardly extending flange capable of serving as a stop against an aperture in a ceiling or wall.

11. The fan assembly according to claim 10, further comprising pivotal clips vertically spaced from an upper side of said outwardly extending flange for attaching said fan assembly to the ceiling or wall.

12. The fan assembly according to claim 10, further comprising clips for connecting said griller to said outwardly extending flange.

* * * * *